United States Patent [19]

Piazza

[11] 4,069,629

[45] Jan. 24, 1978

[54] ANCHORED COMPOSITE BUILDING MODULE

[75] Inventor: Matthew R. Piazza, Nichols, Conn.

[73] Assignee: Maso-Therm Corporation, Bridgeport, Conn.

[21] Appl. No.: 770,258

[22] Filed: Feb. 18, 1977

[51] Int. Cl.[2] ..... E04C 2/04; E04C 5/18

[52] U.S. Cl. ..... 52/125; 52/309.4; 52/309.14; 52/612; 52/741

[58] Field of Search ..... 52/309.4, 309.14, 125, 52/612, 705, 741

[56] References Cited

U.S. PATENT DOCUMENTS

| | | | |
|---|---|---|---|
| 3,236,019 | 2/1966 | Ballou | 52/125 |
| 3,420,014 | 1/1969 | Courtois et al. | 52/125 |
| 3,476,912 | 11/1969 | Garrison | 52/125 |

FOREIGN PATENT DOCUMENTS

| | | | |
|---|---|---|---|
| 481,597 | 3/1952 | Canada | 52/612 |

*Primary Examiner*—Price C. Faw, Jr.
*Assistant Examiner*—James Lee Ridgill, Jr.
*Attorney, Agent, or Firm*—Burgess, Dinklage & Sprung

[57] ABSTRACT

A composite building module and the process for making same. The module is provided with a rigid foam core encapsulated in a shell of reinforced cementitious material and at least one anchor device for attaching the module to external structure for lifting same. The anchor device has a base disposed on a given face of the core with the top of the base flush with the outer surface of the shell. Connected to the base are two positioning members that are inserted into the given face of the core and two load bearing members each extending along a face of the core contiguous with the given face.

17 Claims, 6 Drawing Figures

ANCHORED COMPOSITE BUILDING MODULE

BACKGROUND

This invention relates to a composite module especially useful in building applications which is similar to monolithic cast concrete modules in outward appearance and use, yet has significant improvements in insulating properties and weight reduction. More particularly, this invention relates to a composite module having a rigid foam core encapsulated in a shell of reinforced cementitious material and a built-in anchor device for attaching the module to external structure for the handling, supporting, lifting and/or transporting of same.

Because of increased costs in material and labor, the construction industry has come to use prefabricated building modules, for example wall panels, roof decks and the like. A popular form of construction is known as "curtain-wall" construction and involves the use of a structural steel skeleton to which prefabricated or precast panels are attached. Such curtain-wall panels are commonly cast from reinforced concrete and are provided with a surface finish such as a smooth concrete finish or aggregate imbedded into the face of the panels. These panels are extremely heavy. For example, a four foot by eight foot curtain-wall panel cast from reinforced concrete weighs from about 1,400 to 1,600 pounds and requires heavy construction equipment to install. In addition, these panels provide very poor insulating properties and by themselves are a very poor vapor barrier. This makes necessary further construction to insulate and seal the precast concrete curtain-wall.

The construction industry has long sought improved building elements that will offer advantages in material and construction costs.

The present invention provides a monolithic-like building module with built in anchor devices which is extremely light in weight as compared to precast concrete panels, for example, and which has greatly improved insulating and vapor barrier properties per se.

A rigid core has each anchor device positioned on one given face so that the base thereof extends upwardly from the base and two positioning members are inserted into the face and two load bearing members each extend along a face of the core contiguous with the given face. The core and anchor devices are then encapsulated with reinforced cementitious material so that the outer surface of the shell is flush with the top of the base of each anchor.

SUMMARY

The composite module of the invention has a rigid foam core, at least one anchoring device for attaching the module to an external support structure including load bearing members extending along faces contiguous to the anchored face and a reinforced shell of cementitious material encapsulating the core and anchoring devices. The cementitious shell is reinforced with a first fibrous reinforcing material in fiber form distributed in an interconnected random matrix substantially throughout the shell and/or a second fibrous reinforcing material in scrim form adjacent at least one face of the foam core where anchoring means are disposed. Preferably, the scrim reinforcing material is adjacent, tht is, just underneath the surface, of the entire surface of the shell and completely surrounds the anchoring device and the rigid foam core therearound.

The composite modules are made according to the present invention by providing a rigid foam core, for example of rigid polyurethane foam having a density in the range of two to five pounds per cubic foot. The anchoring devices are then positioned on given faces of the core with the positioning members inserted in those faces and the load bearing members extending along the faces contiguous therewith.

A mold having a bottom and side walls is provided and then a mixture of wet cementitious material and fibrous reinforcing material in fiber form is deposited in the bottom of the mold to form a layer of wet cementitious material reinforced with an interconnected matrix of the fibrous material.

With the wet reinforced cementitious layer in place, the rigid foam core is placed on the layer. The foam core member, preferably pre-formed from rigid polyurethane foam, has a peripheral shape smaller than the mold interior leaving a free space between the core and the mold side walls. The core also has a thickness less than the height of the mold side walls.

With the core member in place, a further mixture of wet cementitious material and fibrous reinforcing material is deposited to fill the free space and cover the core member and anchoring devices and be flush with the top of the anchoring device, thereby encapsulating the core member in a shell of cementitious material reinforced with an interconnected matrix of the fibrous reinforcing material.

At this point, scrim reinforcing material can also be applied to the core to cover the anchoring devices and the contiguous faces to add further strength to the mounting of the anchoring devices.

As a last step, the cementitious material is allowed to cure and the finished module is then removed from the mold.

In a preferred embodiment, the steps of depositing the mixture of wet cementitious material and fibrous reinforcing material are carried out successively be depositing fibers and then wet cement material while vibrating the mold. The steps of depositing fibers and then wet cement material can be interchanged and repeated as many times as desired.

DESCRIPTION OF THE DRAWING

The pesent invention will be more fully understood from the following description taken in conjunction with the accompanying drawings wherein.

DESCRIPTION

Figure 1:
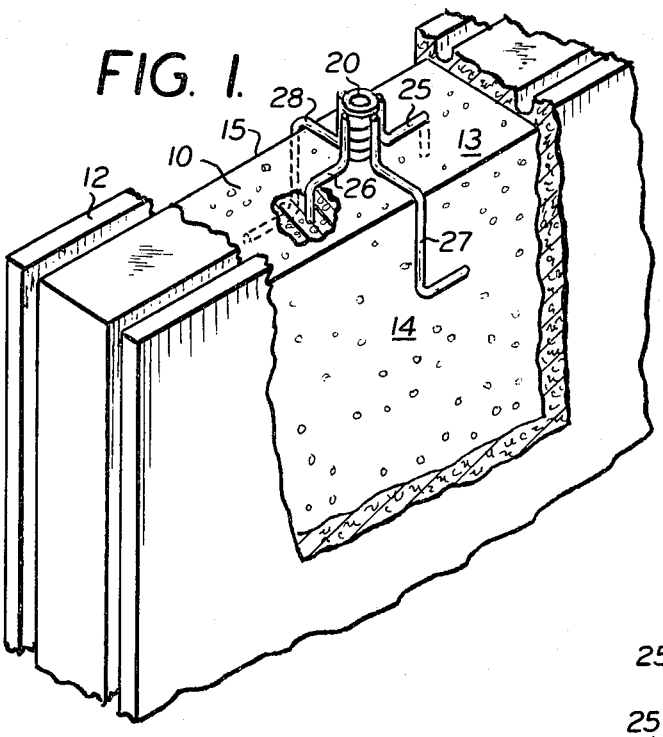
FIG. 1 is a partly broken away perspective view of a composite module according to the present invention.

Referring now to the drawings which will be described with reference to the preferred embodiments wherein the fibrous reinforcing material is glass fiber and the scrim reinforcing material is aramid fiber (e.g. KAVLAR—duPont) and the rigid foam core is polyurethane foam, FIG. 1 shows a polyurethane foam core 10 having a face 13 and contiguous faces 14 and 15. At least one anchoring device 20, of which one is shown in FIG. 1, is disposed on the face 13 with positioning members 25, 26 inserted into face 13 and load bearing members 27, 28 extending along and closely received against faces 14, 15 respectively. A cement shell 12 then encapsulates the core 10 and anchoring device 20 with surface 11 substantially flush with the top of anchoring device 20 (see FIG. 2).

The interaction of the cement shell on the foam and the encapsulation of the load bearing members 27 and 28 enables the anchoring device to be firmly mounted into the module and to support the weight of the module when lifted in conjunction therewith.

Figure 4:
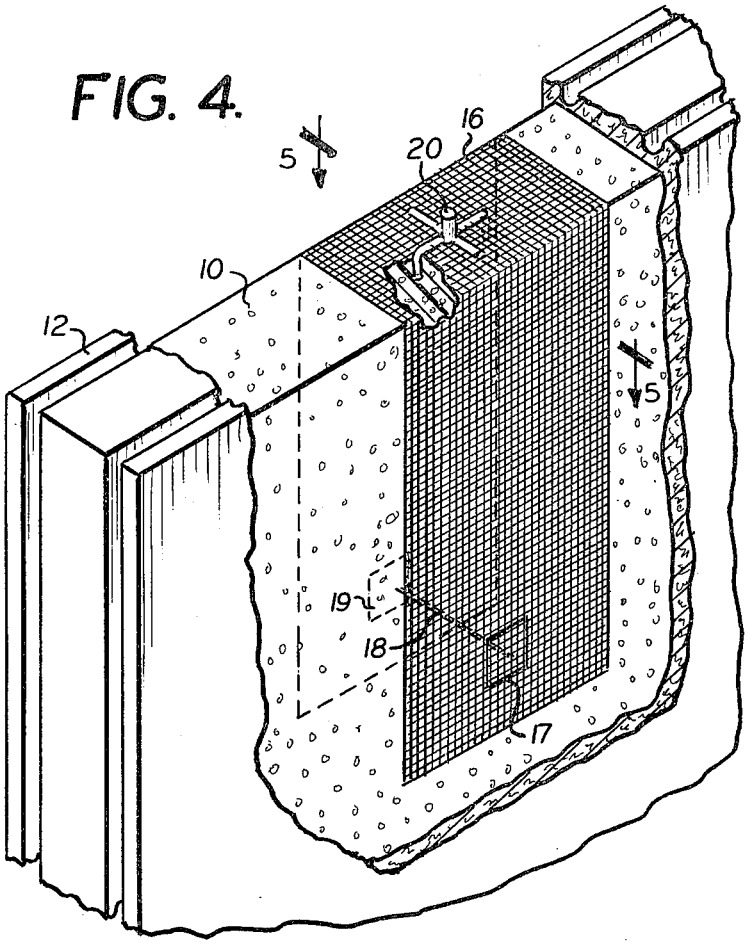
FIG. 4 is a partly broken away perspective view showing the composite module with the core member wrapped in scrim reinforcing material around the anchoring device.
Figure 5:
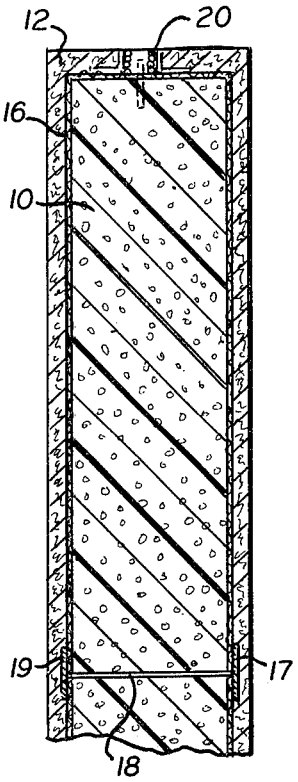
FIG. 5 is a cross-sectional view along line 5—5 of FIG. 4.

In another embodiment, the anchoring device is still further strengthened by convering same with scrim material 16 with the base extending through the scrim 16. The scrim material is further held in place by a mounting device including two flat metal members 17, 19 which are outside the scrim and connected through the foam core 10 by connecting rod 18 as shown in FIGS. 4 and 5.

In these embodiments, the aramid fiber scrim 16 is shown covering the anchoring device 20 and adjacent the major surfaces 13, 14, 15 of the core. As shown in FIGS. 4 and 5, the scrim reinforcement 16 can be just below the surface of the shell 12 and care should be taken to thoroughly imbed the scrim reinforcement 16 into the cement/glass fiber shell 12. Stated differently, to insure maximum reinforcement, the glass fiber matrix and the scrim reinforcement 16 should be thoroughly wetted by the cementitious material.

The term "scrim" is used herein to include woven, non-woven and dense chopped fiber layers (e.g. layer 18, FIG. 4) which functions as a reinforcing layer with respect to the composite modules of the invention. The scrim material can be coarse or fine so long as it is sufficiently open to allow the cementitious mixture to penetrate and wet the scrim layer itself. Generally, the scrim reinforcing material will have a screen-like appearance with openings as small as an eight of an inch up to two inches or more, preferably with openings of about a quarter of an inch up to 1 inch. Naturally, the type and configuration of the scrim reinforcing material will depend on the ultimate use for the module being produced. For example, for roof deck panels or curtain-wall panels measuring approximately 5 by 10 feet and 4 inches thick, a single layer of aramid fiber scrim with openings of approximately one half inch either surrounding the foam core or adjacent to the major surfaces, that is, the front and back of the panel, has been found to provide adequate reinforcement for these particular applications.

The fibrous reinforcement in fiber form is preferably glass fiber chopped from rovings in lengths of one quarter to three inches and preferably from one to two inches. A preferred glass fiber is AR (alkali resistant) glass fiber sold uner the trademark CEM-FIL and more particularly described in U.S. Pat. No. 3,901,720 issued Aug. 26, 1975.

For glass reinforced concrete (GRC), the generally recognized glass content is about five percent by weight with the glass fibers being distributed in an interconnected random matrix. However, through the use of a scrim reinforcing material according to the present invention, the amount of glass fiber reinforcement in the matrix can be reduced down to 1 to 3 percent by weight and preferably about 2 percent by weight. This results in increased efficiency in handling and cost savings.

Because of availability and cost, the preferred fibrous reinforcement is glass fiber, and preferably AR glass fiber, and the scrim reinforcing material is preferably an aramid scrim fiber such as described above. However, other similar and equivalent fibrous materials can be used for the fibrous reinforcing materials within the context of the present invention. For example, the fiber and/or scrim reinforcing materials can be the same or different and can be made from conventional E glass fiber, (including E glass fiber coated to in part alkali resistance to the glass, for example, with a polyester coating) AR glass such as glass such as described above, aramid fibers again as described above, nylon fibers, polyester fibers, and the like including natural and synthetic inorganic and organic fibers, for example graphite fibers.

The cementitious material is preferably common cement in admixture with conventional fillers such as sand or pumice and can contain conventional additives such as lime and stearates for water resistance, latex for added strength and wetting ability with respect to the fiber reinforcement, and water reducing agents such as "Pozzilith" for quick setting. Conventional tints or dyes can also be used to provide the desired coloration.

It is also possible to use as a cementitious material a sulfur based product marketed under the trademark SUMENT by Chevron Chemical Company. This sulfur based material can be used in admixture with sand or other conventional fillers following known techniques for handling this type of material.

The glass fiber reinforcement can be incorporated into the cementitious material in an interconnected random matrix by premixing or by successively applying wet cementitious material and chopped and sprayed glass fiber onto a vibrating surface. With conventional GRC where the glass content is generally about five percent by weight premixing of the glass and cement is generally not possible without disturbing or destroying the glass fiber matrix distributed throughout the cement layer. However, it is possible to premix and preserve the glass fiber matrix when using less than five percent by weight glass for example two percent by weight glass. The present invention thus provides an additional advantage in being able to use a premix of wet cement and glass fibers in amounts of one to three percent by weight.

Mechanical treatments can also be employed to work the glass fiber matrix and/or scrim reinforcing material into the wet cement mixture. For example rollers made of wire, grid or mesh can be applied to the mixture of glass fiber and cement and/or the scrim reinforcing material to insure thorough wetting of the reinforcing materials by the cement. The use of dilute latex can also assist in the wetting operation.

Figure 3:
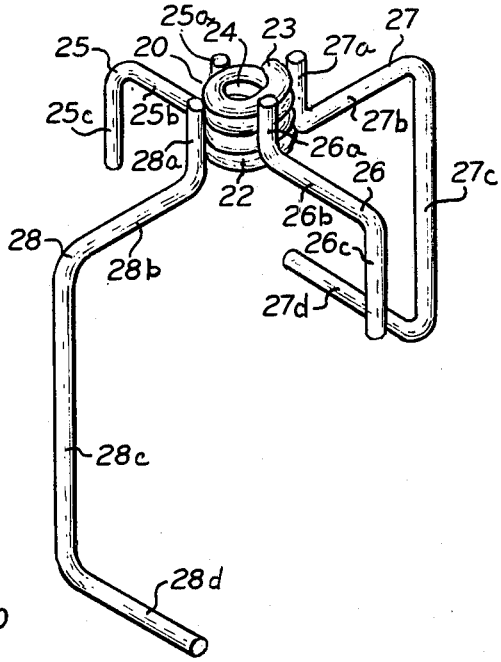
FIG. 3 shows the anchoring device for use in the invention.

Referring to FIG. 3, the anchoring device 20 includes base 22 which has a top portion 23 and threaded bore 24. Preferably, the base 22 is formed by a spring-like coil with the threaded bore 23 comprising the inner surface of the coil.

The anchoring device 20 also includes two diametrically opposed positioning members 25, 26 bonded (e.g., by welding) at connecting portions 25*a*, 26*a* to base 23. The positioning members 25, 26 also include intermediate portions 25*b*, 26*b* which rest on face 13 when the device 20 is put into position and inserting portions 25*c*, 26*c* which are inserted into face 13 of core 10 to firmly position the anchoring device in place when the core is being encapsulated. As shown, two positioning members are used, but one or more can be used depending upon the application or preference.

The anchoring device 20 further includes two diametrically opposed load bearing members 27, 28 bonded (e.g., by welding) at connecting portions 27*a*, 28*a* to base 23. The load bearing members 27, 28 also include intermediate portions 27*b*, 28*b* that rest on face 13 when in position, vertical portions 27*c*, 28*c* and horizontal portions 27*d*, 28*d*. The horizontal and vertical portions preferably lie in a plane parallel to contiguous faces 14 and 15 and are preferably tightly received about core 10 on faces 14 and 15.

In alternative embodiments, additional vertical and horizontal portions could be used and the orientation of the portions could also be at other angles rather than the right angles shown. Additionally, where there is a suitable positioning of the anchor device and a suitable size of the core, additional load bearing members could be used that are contiguous to other than the two surfaces shown.

Further, the members 25, 26, 27, 28 are each preferably integral and each formed from an integral metal rod.

Figure 2:
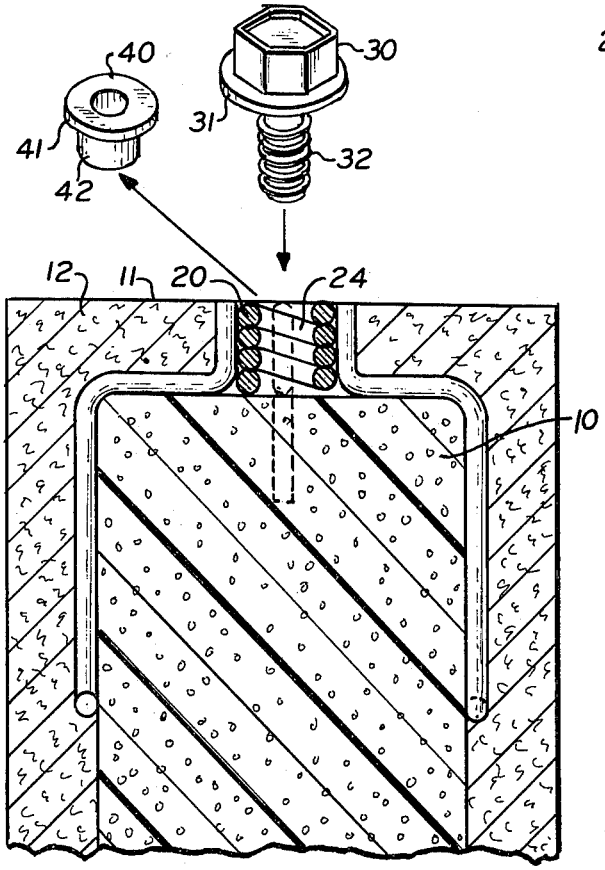
FIG. 2 is a cross-sectional view of the module shown in FIG. 1.

Referring to FIG. 2, when the core 10 is being encapsulated with the anchoring device 20 in place, cap 40 is provided for positioning in bore 24. Cap 40 includes a cylindrical portion 42 which is received in bore 24 and a flanged top 41 which rests on the top 23 of base 22. When the encapsulation is performed, the cap 40 has the two-fold purpose of preventing any of the cementitious material from entering bore 24 and to indicate by the lower edge of flanged portion 41 what the level of surface 11 of shell 12 should be so that it is substantially flush with the top 23 of base 11.

In use, the threaded bore 24 will accept conventional male connecting devices such as screw 30 having a threaded portion 32 engageable with threaded bore 24. The screw also has a flanged head 31.

Figure 6:
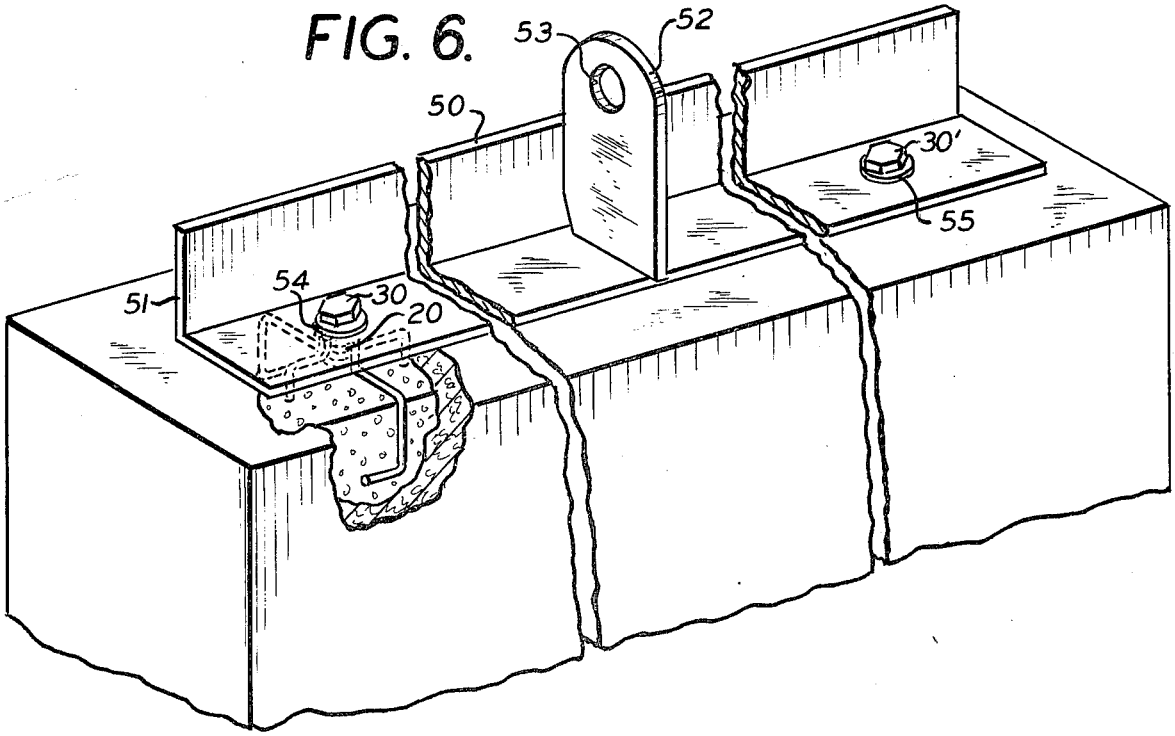
FIG. 6 is a perspective view partly broken away illustrating one embodiment for attaching an external lifting structure according to the invention.

FIG. 6 shows the building module with two anchoring devices (one not shown) built in and lifting member 50 connected to the module. The lifting member 50 includes a body 51 having an L-shaped cross-section and has two apertures 54, 55 therein aligned with the bores in the anchoring devices. The lifting member is releasably connectable to the module with screws 30, 30'. Also included is a centrally disposed member 52 having an aperture 53 therein which may be engaged by a hook or any other suitable lifting apparatus for effecting the lifting, transporting, and/or handling of the building module by construction equipment.

Suitable rigid foams include inorganic and organic foams. Rigid urethane polymer foams are preferred. These well known materials are widely used principally for insulation purposes. Urethane polymer foams are commonly formed by combining the reactants (a polyol and an isocyanate) using airless spraying or liquid application techniques. Foaming commences almost instantaneously and is completed within a very short period of time depending on the type of urethane polymer composition employed. The density of rigid urethane foams also depends on the nature of the urethane composition employed but generally ranges between about 1.5 pounds per cubic foot to 10 pounds per cubic foot, more commonly from 2 to 5 pounds per cubic foot. Other suitable rigid foams include polyester foams, phenolic resin foams, isocyanurate foams and sulfur based foams marketed under the trademark SUFOAM by Chevron Chemical Company.

The process of the present invention for making composite modules will now be described with reference to FIGS. 1-5 of the drawing. The first step is to position the anchoring devices 20 in place on the foam core and then to provide a mold (not shown) having bottom and side walls. A mixture of wet cement and glass fiber in lengths of one to three inches is deposited in the bottom of the mold to form a layer of wet cement reinforced with a glass fiber matrix. The preferred glass loading is 2 percent by weight. The rigid urethane polymer foam core 10 having, for example, a density of 2.5 pounds per cubic foot and the anchoring devices 20 are then placed on top of the layer of wet cement and glass fiber in the bottom of the mold. The core member 10 should have a peripheral shape smaller than the mold interior leaving a free space between the core 10 and the mold side walls. The core member 10 also has a thickness less than the height of the mold side walls.

A further mixture of wet cement and glass fibers is then deposited to fill the free space between the core number 10 and the side walls and to cover the core member 10 and anchoring devices 20 to encapsulate the core member 10 and anchoring devices 20 in the shell of reinforced cement 12 with the outer surface substantially flush with the top of the anchoring device. The cap 40 may be used to facilitate the determination of the proper shell thickness. A sheet of scrim material 16 may also be applied to cover each anchoring device 20 and the surrounding walls with the base of each projecting through the scrim 16.

As mentioned previously it is preferred to form the cement glass fiber matrix reinforced shell 12 by successively depositing chopped glass fibers and wet cement while vibrating the mold. This insures complete wetting of the glass fibers by the cement without disturbing the glass matrix and also thorough filling of the free space between the core number 10 and the sides of the mold.

After fabrication of the module is complete the cement is allowed to cure under ambiant conditions or preferably in a steam heated curing enclosure. Curing can also be accelerated using hot wet cement made with water at about 122° - 200° F. Once the cement is cured the composite module is removed from the mold and is ready for use.

One or more exterior surfaces of the shell 12 can be provided with any desired finished texture or design and can have imbedded therein inorganic aggregates such as gravel, broken stone, marble chips and the like. As for surface design and texture, the exterior of the shell 12 will conform to the surface finish of the mold which makes it possible to achieve desired effects for example a wood grained appearance or a ribbed configuration and the like.

The composite module of the invention can be used and installed in the same manner as conventional building modules such as pre-cast curtain-wall panels, but because of the great reduction in weight and built-in lifting anchors, simplified installation procedures are possible. Because of the greatly improved insulating and water vapor barrier properties the modules of the invention, no further steps have to be taken to insure these properties as is the case with conventional building modules.

In roof deck installations or curtain-wall installations, a room temperature curing elastomer such as a silicone elastomer can be used for edge-to-edge bonding between adjacent modules and the entire installation can be provided with an overcoating of a suitable elastomer. This provides for a shock resistant installation which can also compensate for later movement of a structure for example as a building settles after construction. The edges of the modules according to the invention can also be provided with one or more semi-circular longitudinal grooves to facilitate the use of flexible bead material made for example from synthetic polymer foams such as polyethylene positioned between adjacent modules to provide sealing against moisture and air.

The composite module of the invention can also be formed into insulated pipes and conduits, railroad ties, modular walls and even load bearing modular panels which can incorporate conduits for utilities, window frames, door frames and the like. It should also be noted that the composite module of the invention is buoyant because of the rigid foam core 10 and this can be utilized to advantage in the construction of floating docks and warfs as well as off shore drilling platforms.

Typical properties of commercially available rigid urethane polymer foams are set forth in the following table:

TYPICAL RIGID URETHANE FOAM PROPERTIES

| Density lb./cu.ft. Astm D 1622 | Compressive Strength psi Astm D 1621 | Compressive Modulus psi Astm D 1621 | Shear Strength psi | Shear Modulus psi |
|---|---|---|---|---|
| 1.5–2.0 | 20–60 | 400–2000 | 20–50 | 250–550 |
| 2.1–30 | 35–95 | 800–3500 | 30–70 | 350–800 |
| 3.1–45 | 50–185 | 1500–6000 | 45–125 | 500–1300 |
| 4.6–70 | 100–350 | 3800–12,000 | 75–180 | 850–2000 |

What is claimed is:

1. A composite building module comprising:

a rigid foam core;

at least one anchoring means for attaching the module to an external support structure each comprising a base disposed on one face of said core and having one end extending outwardly therefrom, at least one positioning member connected to the base having a portion extending along said one face and at least two load bearing members connected to said base and each having a portion extending along a face of the core contiguous with said one face; and a reinforced shell of cementitious material encapsulating said core and the anchoring means wherein the one end of the base is substantially flush with the outer surface of the shell.

2. A module according to claim 2, wherein the module comprises two spaced apart anchor means on one face and further comprising removable means for effecting the handling of the module comprising a lifting member having two spaced apart apertures aligned with the two bases and a central lifting aperture and two screws each received through one of the spaced apart apertures and threadably engaged with the screw threads in the associated base.

3. A module according to claim 1, further comprising a layer of a scrim material surrounding the positioned anchoring means and the core adjacent thereto.

4. A module according to claim 12, further comprising two flat metal members disposed against the outside of opposite ends of the scrim material and a rod connecting the flat members through the foam core.

5. A module according to claim 1, wherein the base comprises a substantially cylindrical coil having an inner surface defining a screw thread.

6. A module according to claim 5, wherein the anchoring means comprises two positioning members each having a connecting portion disposed parallel to the longitudinal axis of the base and connected to the outer surface thereof, an intermediate portion connected to the connecting portion and perpendicular thereto and an inserting portion connected to the intermediate and disposed parallel to said connecting portion and adapted to be inserted into said one face of the foam core.

7. A module according to claim 6, wherein the two positioning members are diametrically opposite to each other.

8. A module according to claim 7, wherein the load bearing members each comprise a connecting portion disposed parallel to the longitudinal axis of the base and connected to the outer surface thereof, an intermediate portion connected to the connecting portion and perpendicular thereto and wherein the extending portion is connected to the intermediate portion and lies in a plane parallel to its associated contiguous face.

9. A module according to claim 8, wherein each extending portion comprises at least one portion perpendicular to and one portion parallel to the longitudinal axis of the base.

10. A module according to claim 9, wherein the two load bearing members are diametrically opposite to each other and equally spaced apart from the positioning members.

11. A module according to claim 10, wherein, said base, said load bearing members and said positioning members are each integral and comprise a bent metal rod.

12. A module according to claim 10, wherein the extending portions of said load bearing members are spaced apart to fit tightly against the contiguous faces of said core.

13. A module according to claim 5, further comprising a removable cap having a portion tightly receivable in said base at the one end thereof and a flanged portion for resting on the top of the one end of the base.

14. A process for making a composite building module comprising the steps of:

providing a rigid foam core;

positioning on at least one face of the core at least one anchor having a substantially cylindrical base, at least one positioning member connected to and extending downwardly from the base and at least two spaced apart load bearing members connected to the base, wherein the positioning includes inserting the positioning member with one face of the core and disposing each of the load bearing members along a face contiguous with the one face of the core; and encapsulating the core and the anchor with a reinforced shell of cementitious material wherein the end of the base is substantially flush with the outer surface of the shell.

15. A process according to claim 14, further comprising inserting a flanged cap into the base before the positioning thereof wherein the flange rests on the top of the base to indicate that the outer surface of the shell is flushwhen the outer surface is at the level of the lower edge of the flange.

16. A process according to claim 15, further comprising surrounding the anchor and adjacent areas of the foam core with a scrim material before encapsulating.

17. A process according to claim 16, further comprising mounting the scrim material to the foam core to maintain its position before encapsulating.

* * * * *